US006960174B2

(12) United States Patent
Fenkel

(10) Patent No.: US 6,960,174 B2
(45) Date of Patent: Nov. 1, 2005

(54) THERAPEUTIC BACK EXERCISE MACHINE

(75) Inventor: Randall Fenkel, West Bloomfield, MI (US)

(73) Assignee: Randall Fenkell, West Bloomfield, MI (US)

( * ) Notice: Subject to any disclaimer, the term of this patent is extended or adjusted under 35 U.S.C. 154(b) by 0 days.

(21) Appl. No.: 10/849,526

(22) Filed: May 20, 2004

(65) Prior Publication Data

US 2005/0010145 A1 Jan. 13, 2005

Related U.S. Application Data

(60) Provisional application No. 60/472,112, filed on May 21, 2003.

(51) Int. Cl.[7] ..... A61H 15/00

(52) U.S. Cl. ..... 601/99; 601/102; 601/103; 601/116; 601/126; 606/241

(58) Field of Search ..... 601/23, 24, 26, 601/97, 98, 99, 101, 102, 103, 104, 115, 116, 126; 606/237, 240–244; 602/32, 33; 482/72, 142, 907; 108/153, 155, 156, 158.11; 403/170, 178, 295

(56) References Cited

U.S. PATENT DOCUMENTS

| | | | | |
|---|---|---|---|---|
| 1,098,327 | A | | 5/1914 | Koch |
| 1,280,987 | A | | 10/1918 | Gregory |
| 1,593,014 | A | | 7/1926 | Bushmiller |
| 1,643,040 | A | | 9/1927 | Wentz |
| 1,748,425 | A | | 2/1930 | Odell |
| 2,230,057 | A | | 1/1941 | Hill |
| 2,262,271 | A | | 11/1941 | DeCamp |
| 2,534,587 | A | | 12/1950 | Fisher et al. |
| 2,693,796 | A | | 11/1954 | Warner |
| 2,781,040 | A | | 2/1957 | Hill |
| 2,819,713 | A | | 1/1958 | Buck |
| 2,822,805 | A | | 2/1958 | Hill |
| 2,874,689 | A | | 2/1959 | Gavelek |
| 2,949,911 | A | | 8/1960 | Kennard |
| 3,164,150 | A | | 1/1965 | Reid |
| 3,238,936 | A | | 3/1966 | Siedentop |
| 3,445,205 | A | | 5/1969 | Minohara |
| 3,572,787 | A | * | 3/1971 | Timmerman et al. ..... 403/205 |
| 3,830,233 | A | | 8/1974 | Hill |
| 3,835,844 | A | | 9/1974 | Lang |
| 4,144,880 | A | | 3/1979 | Daniels |
| 4,154,232 | A | | 5/1979 | Fukazawa |
| 4,192,296 | A | * | 3/1980 | St. Mary ..... 601/99 |
| 4,230,098 | A | | 10/1980 | Uematsu |

(Continued)

FOREIGN PATENT DOCUMENTS

| | | |
|---|---|---|
| DE | 1491277 | 8/1963 |
| FR | 2477870 | 3/1980 |

*Primary Examiner*—Michael A. Brown
*Assistant Examiner*—Quang D. Thanh
(74) *Attorney, Agent, or Firm*—Edell, Shapiro, & Finnan, LLC

(57) ABSTRACT

A therapeutic treatment machine alternatingly applies compression and traction to a patient. A frame includes: a platform having an upper body support pad with controllable resistance to forward and backward displacement; rollers supporting the lower back, buttocks and thighs; and a motor-driven foot support displaceable forward and backward predetermined distances and speeds. Tubular frame members fit over and adhesively engage arms projecting orthogonally from a corner section. Legs telescopically receive leg support members extending orthogonally from the arms. Compression and traction are each forcefully effected by motor rotation converted to longitudinal reciprocation of a linkage that drives the foot support. The patient's feet are held in place against footplates by clamps supported on a T-bar cross member having a stem extending forwardly through a longitudinal slot in the footplates. A threaded bolt extends through the slot to engage the platform at selectable locations to secure the T-bar to the footplates.

14 Claims, 12 Drawing Sheets

U.S. PATENT DOCUMENTS 4,242,969 A * 1/1981 Checkwood et al. ... 108/158.11
4,579,109 A 4/1986 Lundblad
4,856,497 A 8/1989 Westphal
4,860,734 A 8/1989 Lyu
4,890,604 A 1/1990 Nelson
5,297,539 A 3/1994 Liebl
5,505,691 A * 4/1996 Fenkell ..... 601/99
5,860,899 A * 1/1999 Rassman ..... 601/24
6,389,987 B1 * 5/2002 King ..... 108/25
6,428,497 B1 8/2002 Crouch
6,508,184 B1 * 1/2003 Winter et al. ..... 108/156
6,682,495 B2 * 1/2004 Park ..... 601/98
2003/0176819 A1 * 9/2003 Kim ..... 601/98

* cited by examiner

THERAPEUTIC BACK EXERCISE MACHINE

CROSS REFERENCE TO RELATED APPLICATIONS

This application claims priority from U.S. Provisional Patent Application Ser. No. 60/472,112, filed May 21, 2003, and entitled "Exercise Machine". The disclosure of that patent application is incorporated herein by reference in its entirety. In addition, the present invention is an improvement over the "Therapeutic Treatment Machine" disclosed in my prior U.S. Pat. No. 5,505,691, issued Apr. 9, 1996 (referred to herein as the '691 patent"), the entire disclosure from which is incorporated herein by reference.

BACKGROUND OF THE INVENTION

1. Technical Field

The present invention relates to methods and apparatus for therapeutically treating the human body and, more particularly, to a method and apparatus for relieving discomfort and pain in the back, spine and neck of a human patient.

2. Discussion of Related Art

The essence of the invention disclosed in my prior in my prior U.S. Pat. No. 5,505,691 (referred to herein as the '691 patent") is the alternating application of compression and traction forces to the body of a patient to therapeutically treat the patient's back. A treatment table has a longitudinally slidable upper body pad for supporting the upper back, shoulders and head of a supine patient, and freely rotatable transversely extending rollers for supporting the lower back, buttocks and thighs of the patient. A selectively controlled, motor driven, movable platform is adapted to engage the feet of the patient. A reversible electric motor longitudinally reciprocates the movable foot platform a pre-selected distance, adjustable by the patient, to sequentially and repetitively place the patient in tension and compression. The spacing between the upper body support pad and the motor-driven foot support platform is adjustable to accommodate differences in patient torso lengths. The magnitude of the compression and traction forces can be selectively controlled by the patient. The table is easily deployed for use and is optimally collapsible into a unit that is easily hand-carried by a patient while traveling.

A commercial embodiment of the invention described my prior patent (the BackPro CPM Motorized Table) was constructed of 1"×2" aluminum tubing, and by welding the table corners. This necessitated Heliarc welding, an expensive, time-consuming process that took over two hours per machine because of the sixty-four locations to be welded. Heliarc welding typically costs in excess of $65.00 per hour.

In addition, the BackPro CPM Motorized Table used a complex operating system consisting of a cable drive activated by a reversing motor controlled by micro-switches and relays. It is desirable, both from a reliability perspective and for user-friendly considerations to simplify this function.

The method used in the BackPro CPM Motorized Table to hold the patient's feet in the molded box involved a t-bar hinged at the bottom and maintained against the foot with force applied against the t-bar by a threaded handle. This proved to be not very effective and was, in fact, ultimately replaced with two straps that went over the feet and around posts attached to the motor box. That strapping method, while holding the feet in place, also meant that the patient, who likely had a sore back to begin with, had to bend forward and stretch to strap his/her feet in place.

OBJECTS AND SUMMARY OF THE INVENTION

Accordingly, it is an object of the present invention to provide a back exercise table of the type disclosed in the '691 patent wherein all of the advantages of the table are maintained but the disadvantages described above are eliminated.

It is a more specific object of the present invention to provide an improved structure of the back exercise table disclosed in the '691 patent which eliminates the need for Heliarc welding.

It is another object of the present invention to provide an improvement over the back exercise table disclosed in the '691 patent in the form of a simpler method and apparatus for the effecting reciprocating motion that produces the alternating compression and traction forces.

It is still another object of the present invention to provide an improvement over the back exercise table disclosed in the '691 patent in the form of a simpler method and apparatus for engaging the feet of the patient using the table.

The aforesaid objects are achieved individually and in combination, and it is not intended that the present invention be construed as requiring two or more of the objects to be combined unless expressly required by the claims attached hereto.

In accordance with one aspect of the present invention, cast aluminum corner members are provided with open U-shaped connector members extending therefrom, each connector member having a pair of parallel spaced arms adapted to be slidably inserted into an elongated tubular frame component of the table. The orthogonally related arms of the U-shaped connectors are secured in the aluminum tubular frame members by means of an adhesive, typically a two-component acrylic glue. Each corner member additionally includes a leg engagement member, orthogonally related to the arms and adapted to be removably received in a tubular table leg and held in place by means of a V-shaped plastic spring, or the like. The entire corner member, including the frame engaging arm and the leg engagement member, is preferably made from a single piece of cast metal, preferably aluminum. With this construction and the elimination of the welding steps, a table can be manufactured every fifteen minutes or less.

In accordance with another aspect of the invention, the cable drive arrangement of my prior patented system is replaced by a simple rotating drive arm or plate driven by a gear motor to reciprocate the foot platform. The drive arm drives a linkage arm which reciprocates longitudinally. When the power switch is actuated 12VDC is fed to a timer that is manually adjusted by the patient to set the duration of a treatment. The timer passes current to the gear motor causing the motor drive arm to be rotated and the foot platform to be reciprocated by the linkage arm. A microswitch is normally closed and connected in parallel with the timer to permit activation of the gear motor until the arm of the microswitch is depressed. Therefore, when the timer, which is adjusted by the patient to set the duration of the treatment, completes its cycle, current is still fed to the gear motor until the motor drive arm actuates the microswitch at the end of a foot platform reciprocation cycle. This opens the circuit and stops the gear motor in the correct position. This arrangement effects the necessary reciprocating motion with a much simpler mechanism than described in my prior patent, thus saving a considerable amount of time and money, while accomplishing the same goal.

The approach in the present invention to holding the patient's feet in place utilizes a T-bar having an adjustment slot and held in place on the motor box with a threaded handle. This system allows the user to set T-bar one time while seated or standing, and then to slide his/her feet into position from the sides while in a supine position on the machine, thereby locking the feet in place on the foot platform when the machine is to be used.

A second advantage of this arrangement is that the force applied to the T-bar presses the T-bar against the motor box, thereby stabilizing the T-bar rather than applying forces tending to tear the T-Bar from the motor box.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DESCRIPTION OF THE PREFERRED EMBODIMENTS

Figure 1:
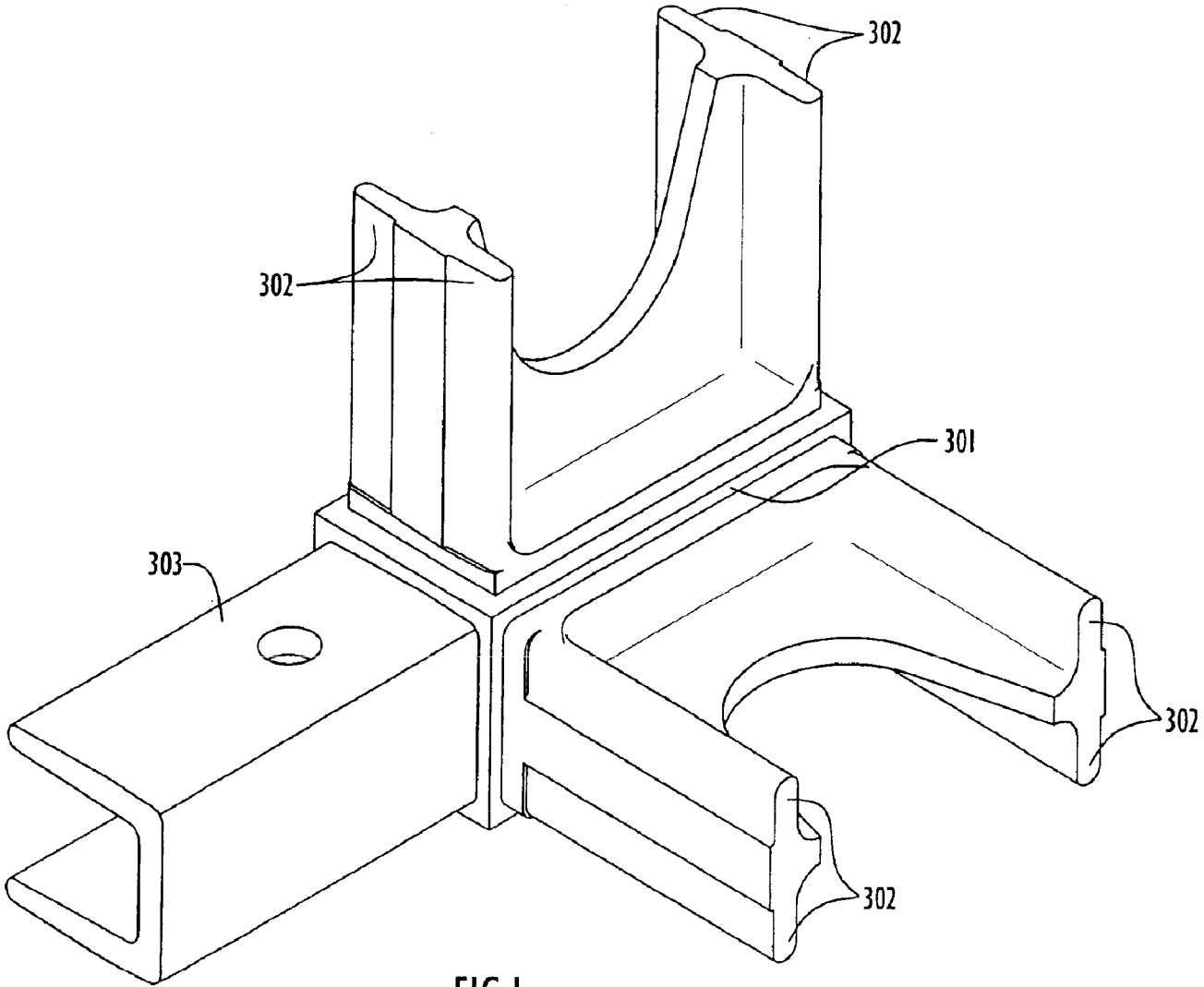
FIG. 1 is a perspective view from below of a corner member utilized in the frame of the therapeutic back exerciser according to the present invention.

Referring to the accompanying drawings in greater detail, a therapeutic treatment machine 10 according to the present invention includes a rectangular table frame 12 supporting an upper body pad 14 located toward the head end of the table, a series of six freely rotatable massage rollers 16 located toward the middle of the table and a motor driven, longitudinally and selectively reciprocable foot support platform 20 located toward the foot end of the table. Rectangular frame 12 is made of, for instance, aluminum angle or tube, and has a forward or torso-supporting frame section 26 housing the upper body pad 14 and rollers 16, and a rearward or foot-supporting frame section 28 housing the foot support platform 20. Frame sections 26 and 28 are rectangular and of similar size and shape. Forward section 26 has a forward or head end member 30 and a rearward end 34 extending transversely between opposite longitudinally extending side members. Table legs 40 support the machine at a convenient height for ease of use (e.g. twenty to twenty-four inches) and extend downward from the four corners of forward frame section 26. Rearward frame section 28 has transversely extending forward end 42 and rearward end 46, and opposite sides 48 and 50. Table legs 40 extend downward from the back corners at rearward frame section 28. Table legs 40 are removably attached to frame 12 for ease and compactness of storage and may be conveniently but removably locked into frame 12 with spring-loaded detents of conventional design. Forward frame section rearward end 34 may be connected along the lower surface to the lower surface of rearward frame section forward end 42 by a hinge to allow the two sections to be folded together for portability and storage compactness.

Figure 2:
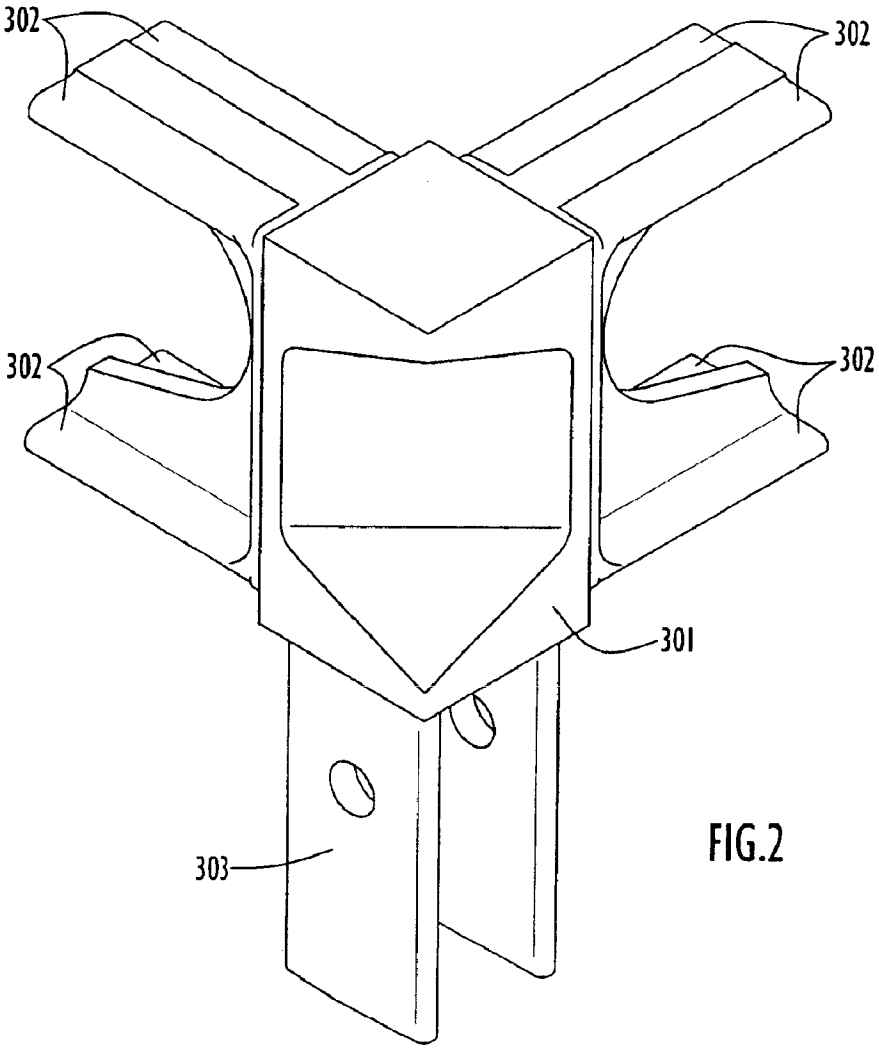
FIG. 2 is a perspective view from above of the corner member of FIG. 1.
Figure 3:
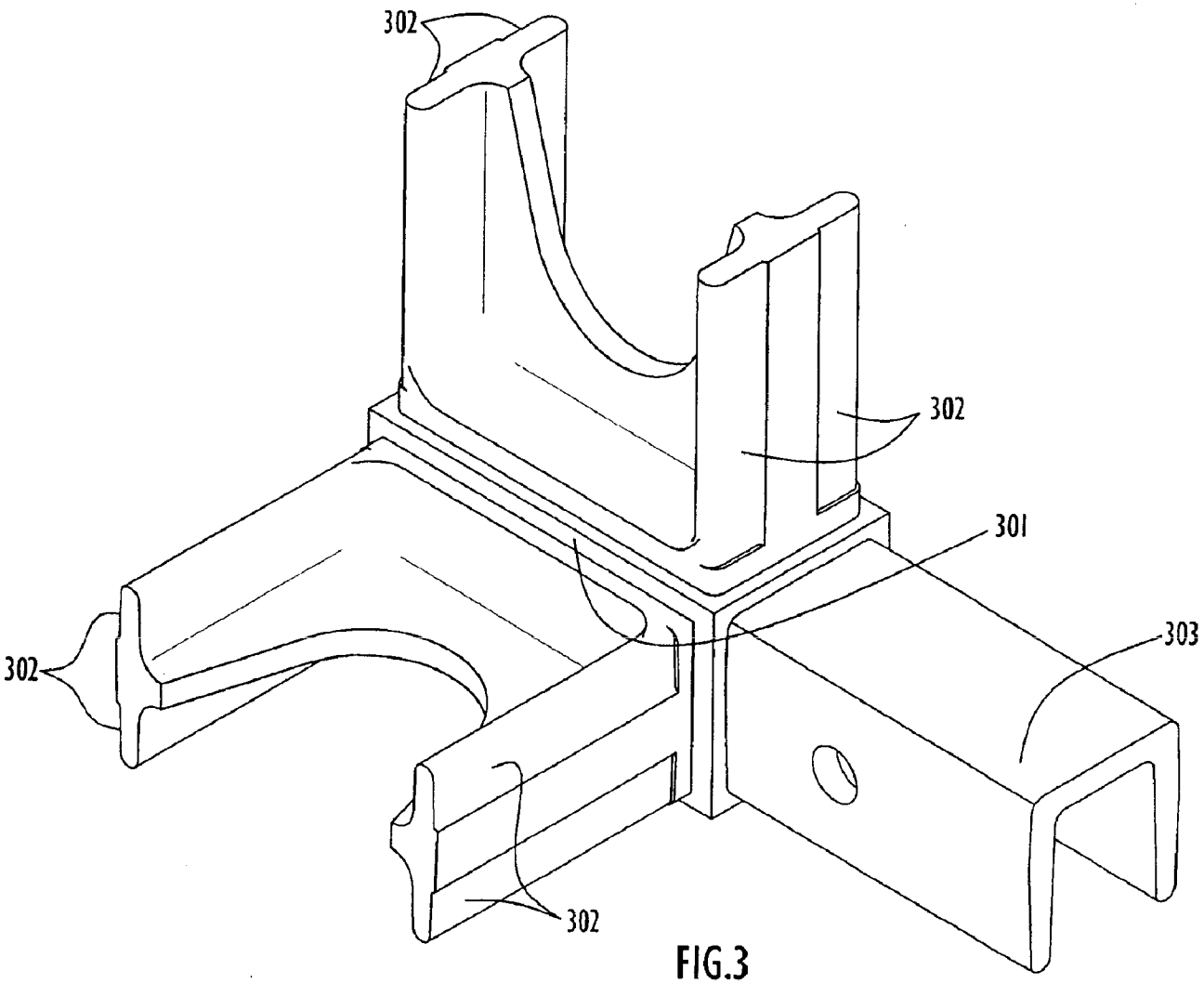
FIG. 3 is a perspective view from below of another embodiment of the corner member utilized in the frame of the therapeutic back exerciser according to the present invention.
Figure 4:
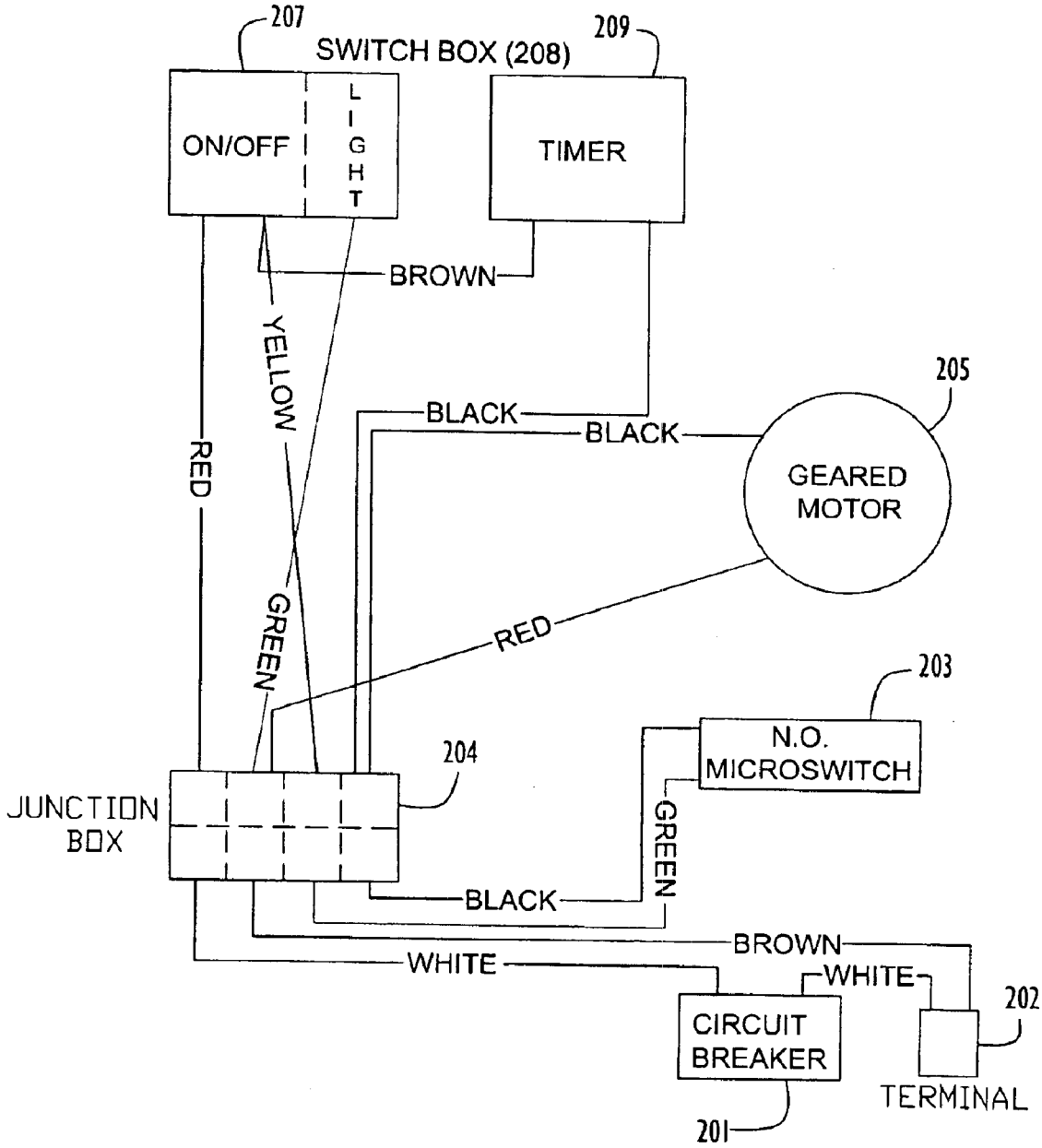
FIG. 4 is a schematic diagram of the electrical circuit used to control operation of the back exerciser according to the present invention.
Figure 5:
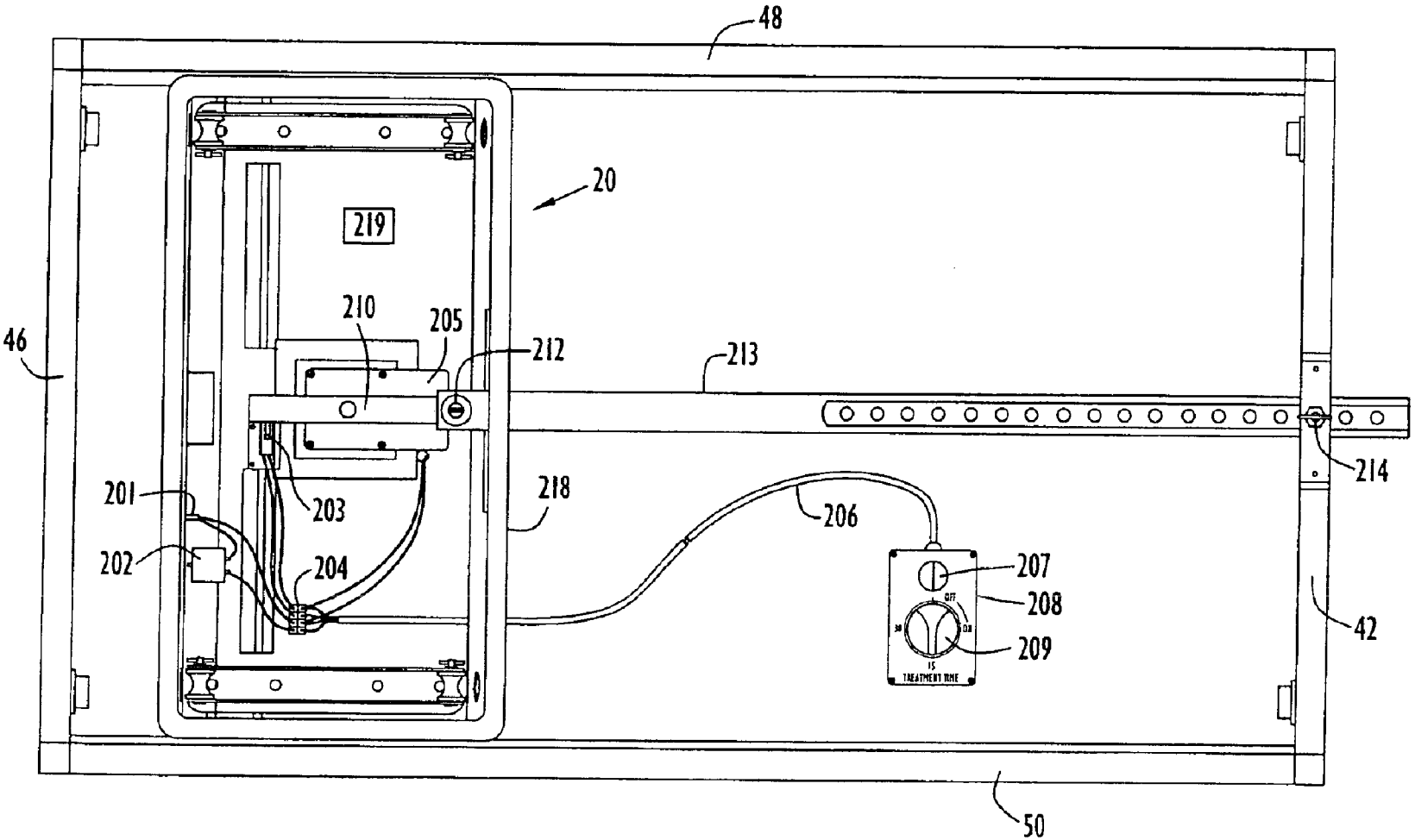
FIG. 5 is a bottom view in plan of the therapeutic back exerciser according to the present invention.
Figure 6:
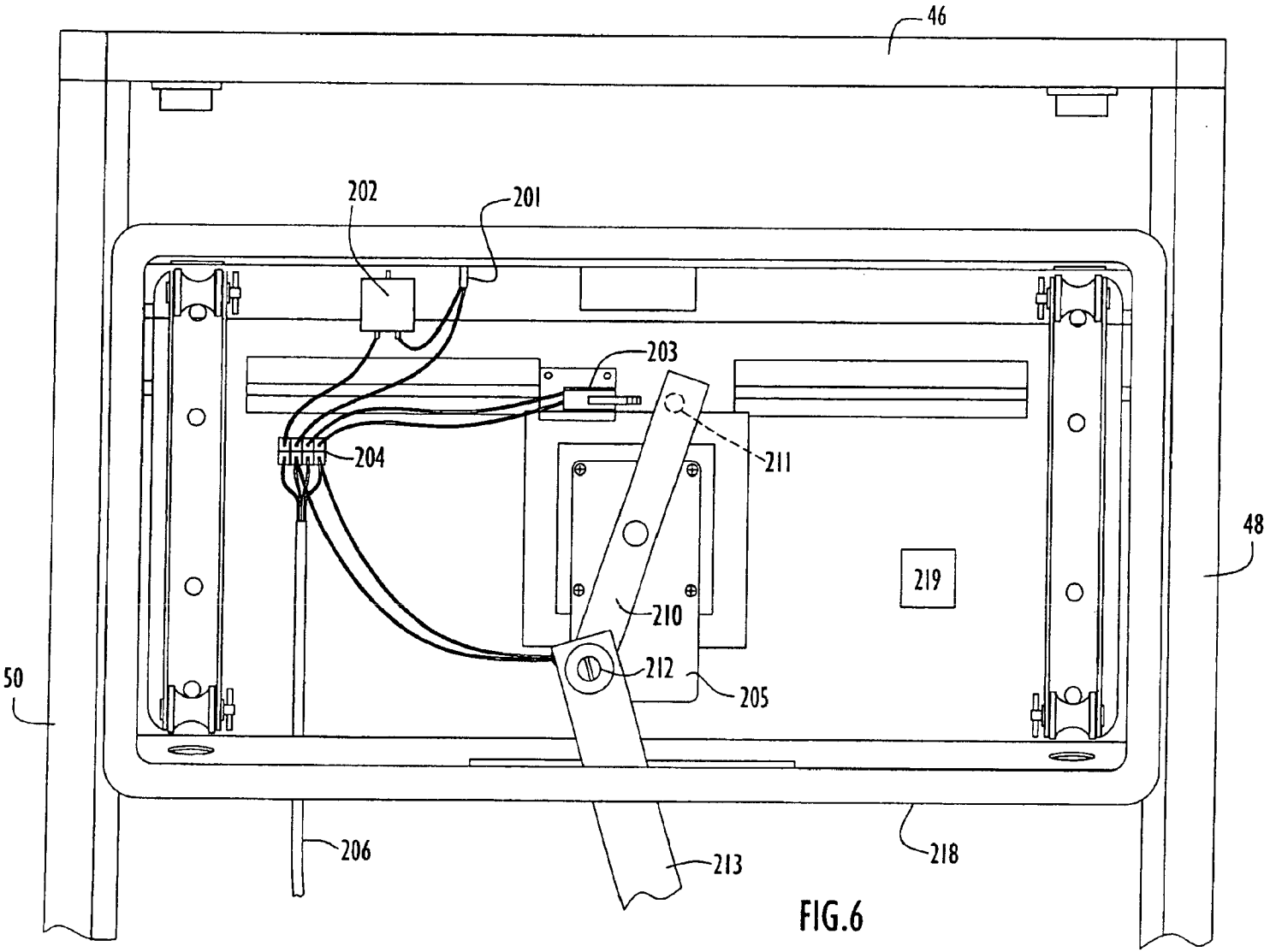
FIG. 6 is a detailed bottom view in plan of the foot platform portion of the therapeutic back exerciser of FIG. 5.
Figure 7:
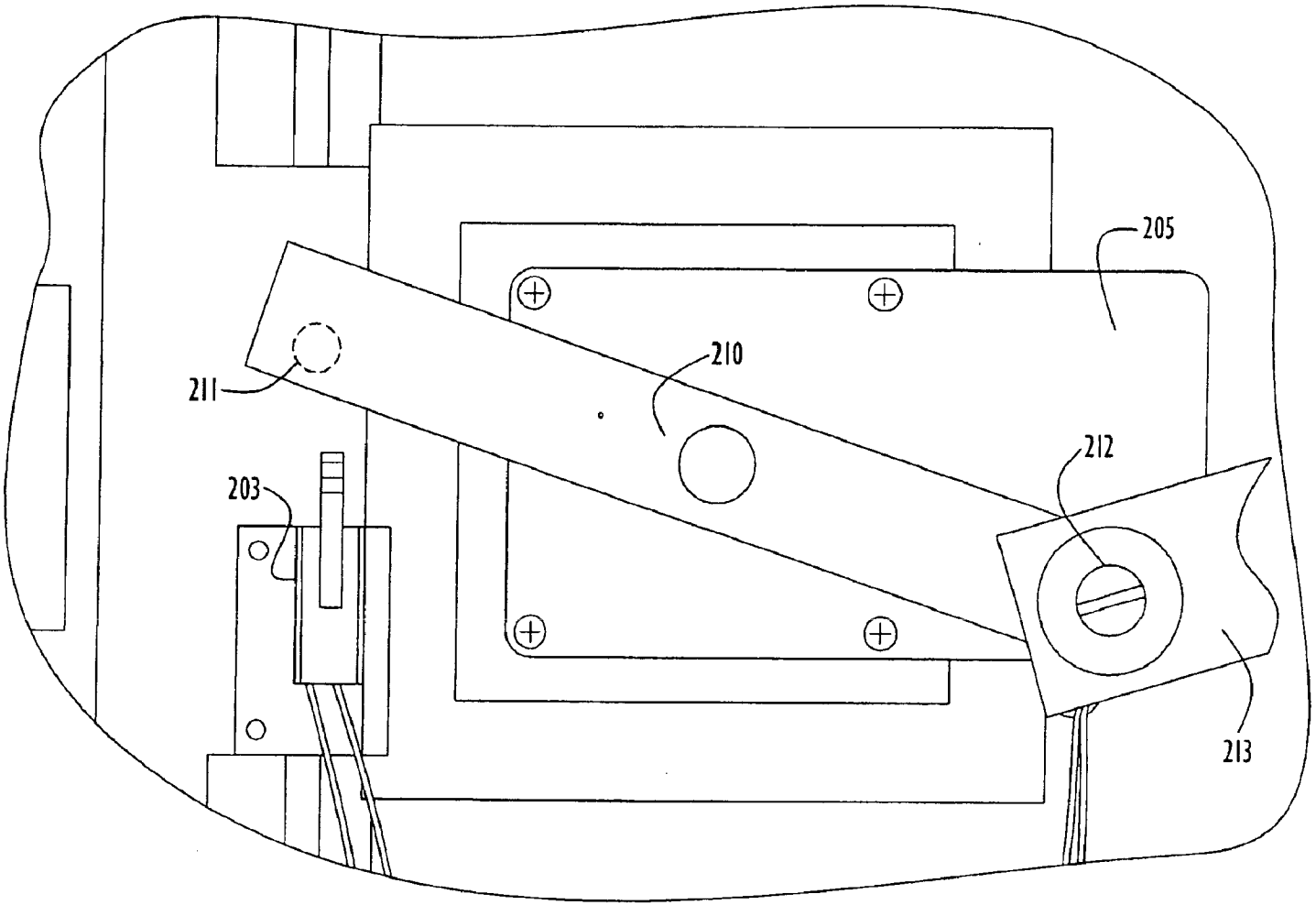
FIG. 7 is a detailed bottom vies in plan of the motor and motor drive bar portion of the therapeutic back exerciser of FIG. 6.
Figure 8:
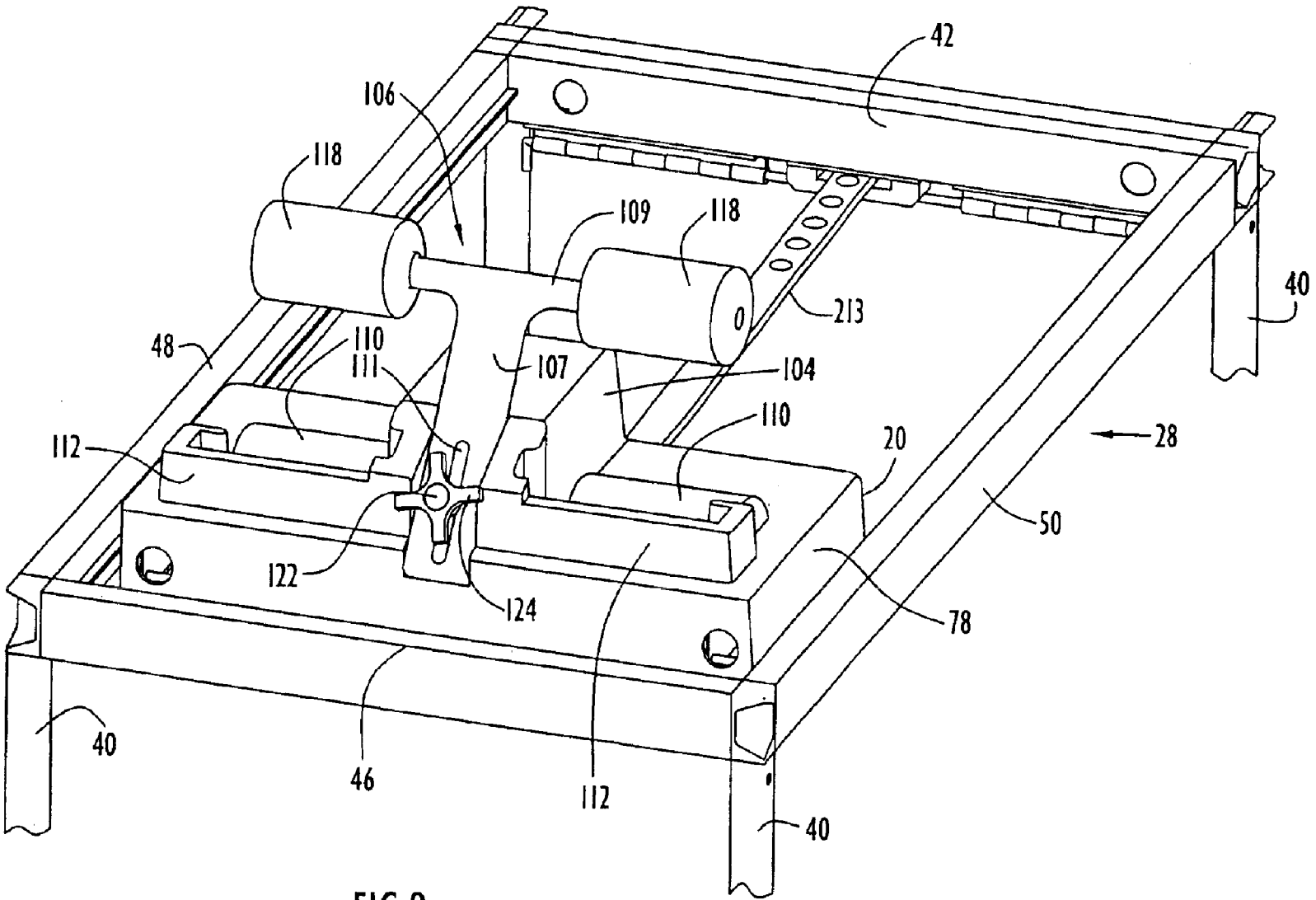
FIG. 8 is a perspective view from above of the foot platform end portion of the therapeutic back exerciser of FIG. 4.
Figure 9:
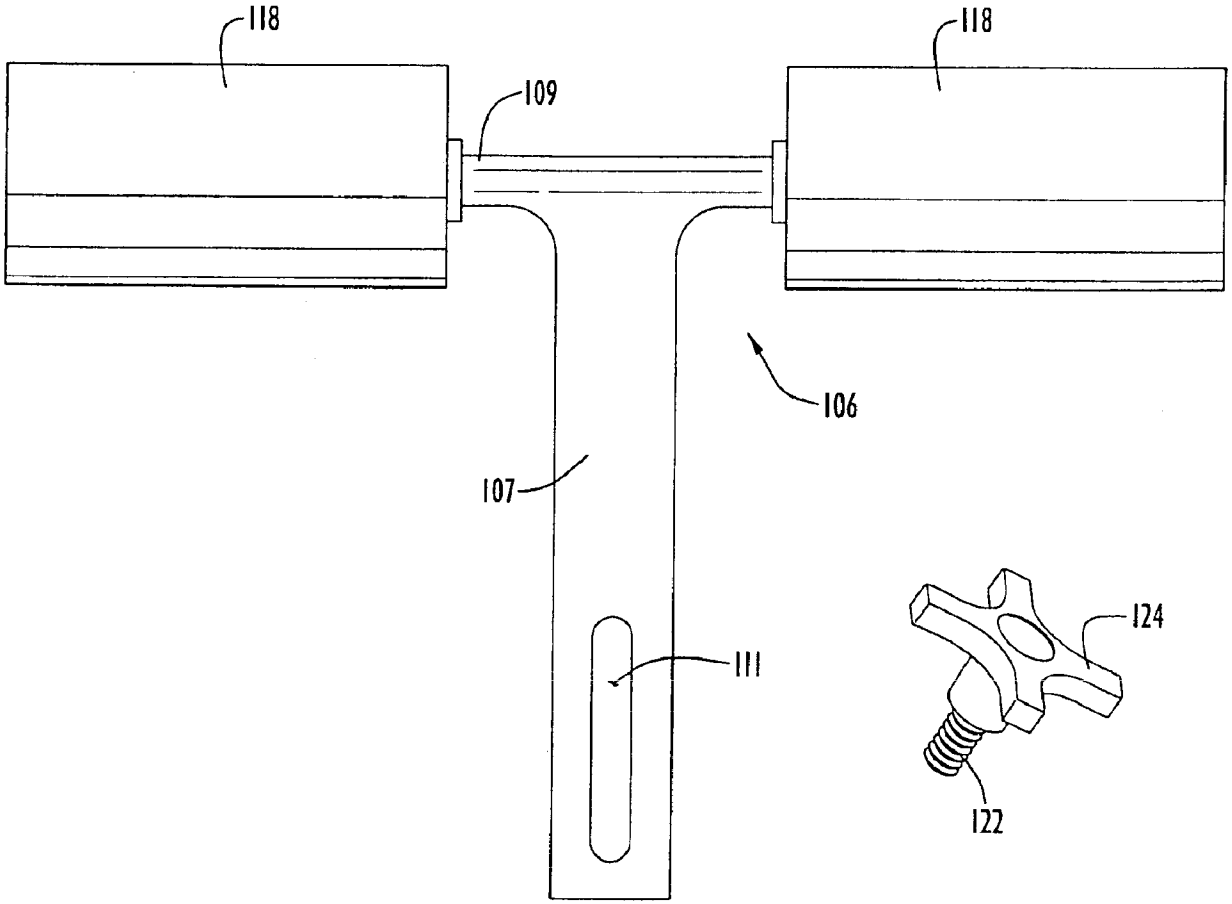
FIG. 9 is an exploded view in partial perspective of the T-Bar and adjustment screw utilized in FIG. 8.
Figure 10:
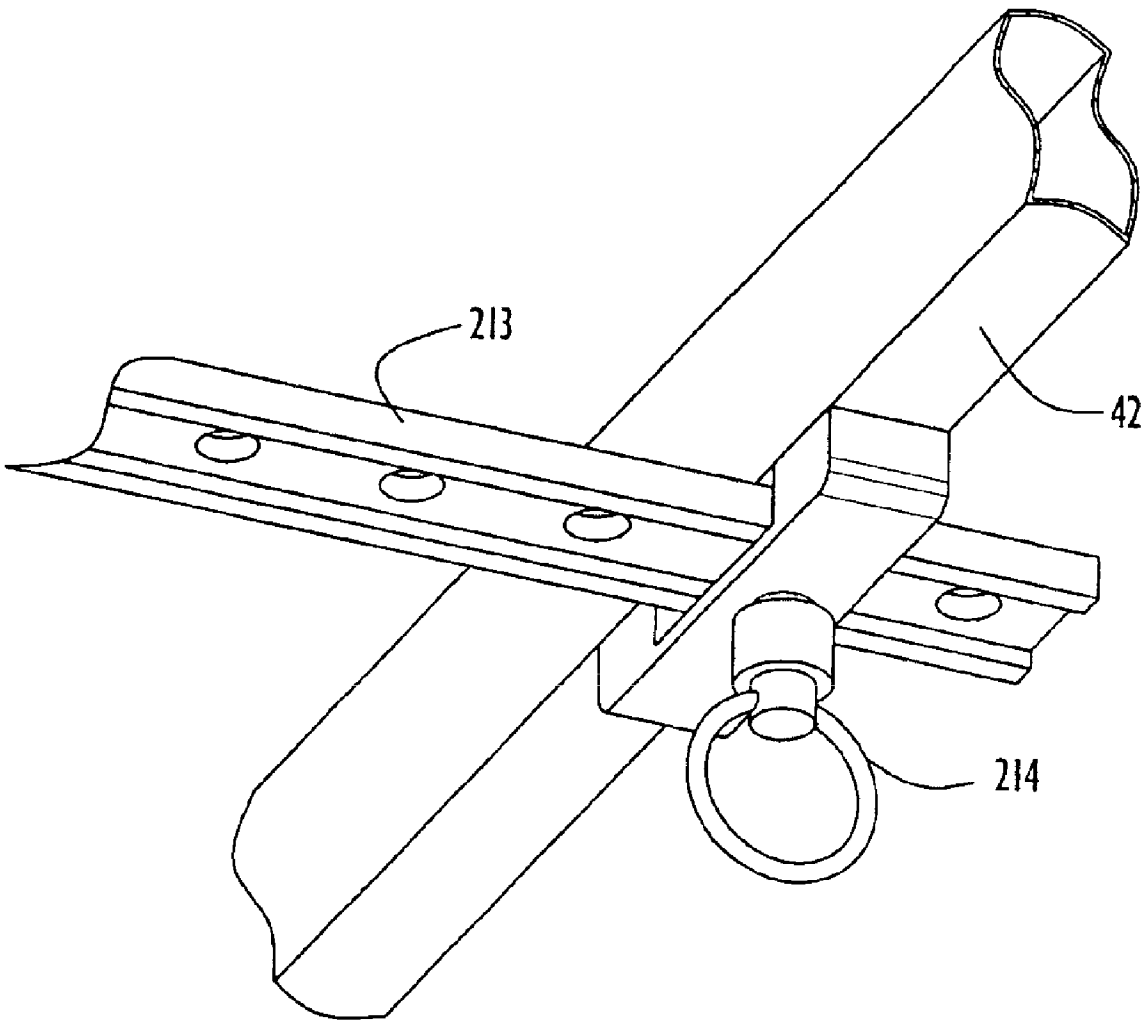
FIG. 10 is a view of the patient height adjustment of the cartridge embodiment in FIG. 4.
Figure 11:
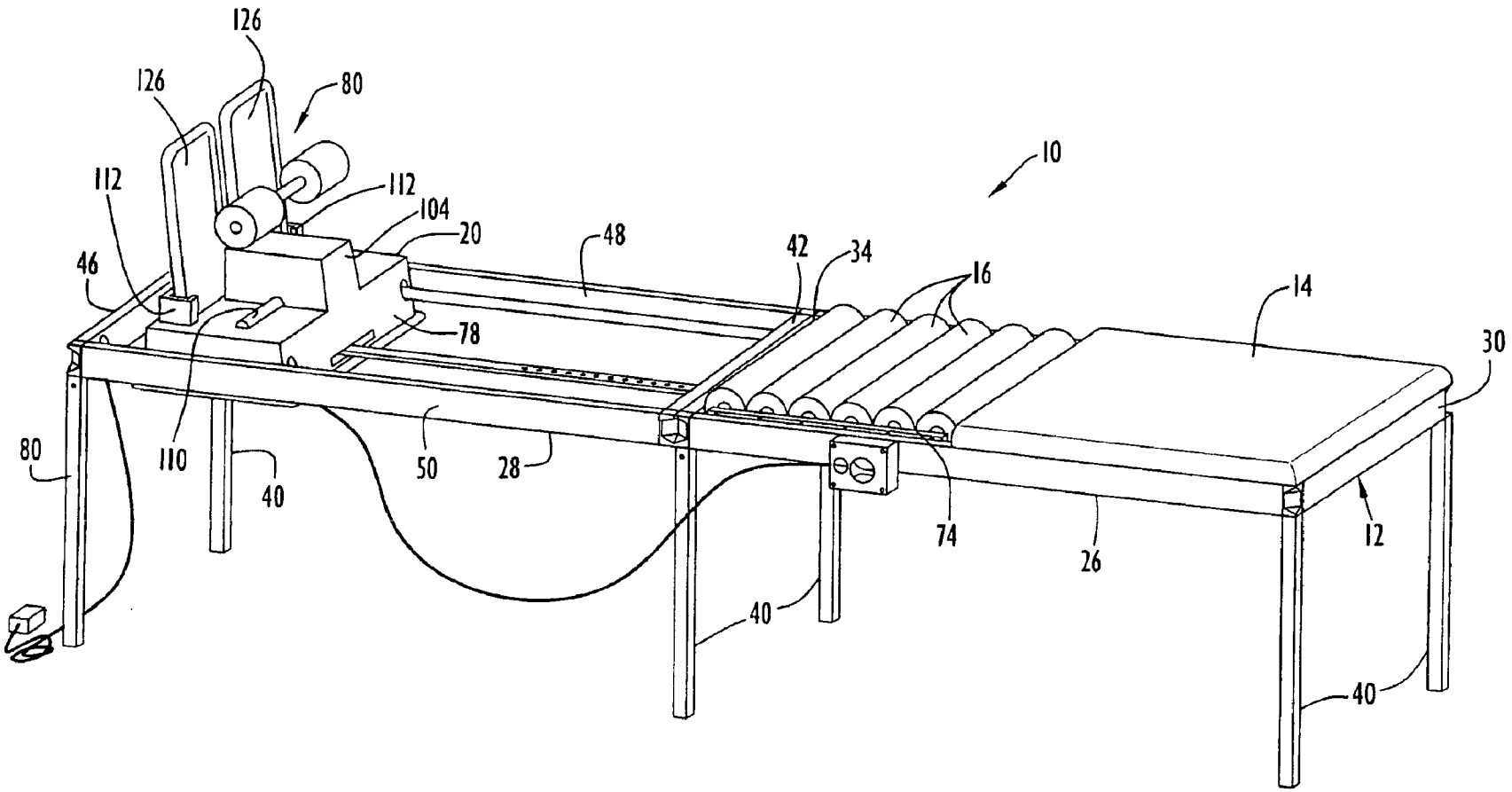
FIG. 11 is a view in perspective of the therapeutic back exerciser according to the present invention.
Figure 12:
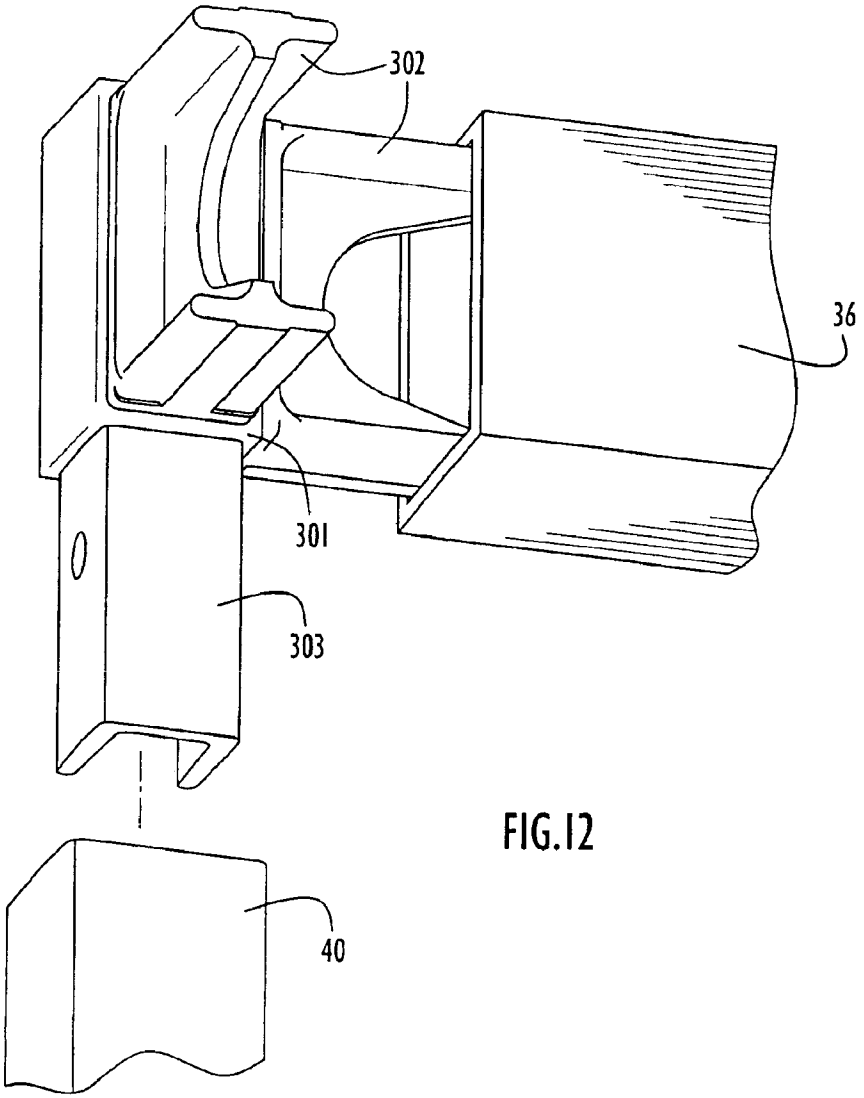
FIG. 12 is a perspective view of a corner member of FIG. 1 showing the method of connecting the corner member to a frame member and a leg of the machine of the present invention.

As best illustrated in FIGS. 1, 2, 3 and 12 of the accompanying drawings, the corner joints of the table frame have a unique and simple construction that permits relatively rapid assembly of the table during manufacture. Cast aluminum corner members 301 are provided with open U-shaped connector members extending therefrom in orthogonal relation, each connector member having a pair of parallel spaced arms 302 adapted to be slidably inserted into an elongated tubular frame component, for example frame side 36, of the table. The arms 302 of the U-shaped connectors are secured in the aluminum tubular frame members by means of an adhesive, typically a two-component acrylic glue. Each corner member 301 additionally includes a leg engagement member 303 adapted to be removably and telescopically received in a tubular table leg 40 and held in place by means of a V-shaped plastic spring, or other conventional detent mechanism for telescoping members. With this construction and the elimination of the welding steps, a table can be manufactured every fifteen minutes or less.

The connector arms 302 are sized and spaced to provide a slidable fit into the frame members 36, et al, which are typically one inch by two inch cross-section aluminum tubes. The leg engagement member 303 is sized to slidably fit into a leg 40 which is typically a one inch square cross-section aluminum tube. The cast one-piece corner members are very inexpensive, and the adhesive attachment technique is much faster and less expensive than Heliarc welding.

Two or multi-component adhesive or sealant systems consist of two or more resins or a resin and a hardener, crosslinker, activator or catalyst that when combined react and cure into a polymerized compound or bond. The component systems are typically mixed immediately before assembly and then applied.

The process for constructing the frame at each corner is as follows.

A. The two-part acrylic glue is in a two-part tube that has a mixing nozzle on the end and is dispensed with a gun onto a Teflon sheet.

B. The glue is inserted into the end of a frame member (e.g., member 36) along the end portions of the two shorter (e.g., one-inch) sides of the aluminum tube with a plastic applicator.

C. The glue is applied to the arms 302 which are then slid into the tubular frame member 36.

D. After all the corners are assembled the frame is put into a jig and allowed to cure for seven to eight minutes, after which the frame is removed and the next frame that was being assembled during the cure time is ready to be put in the jig.

As best illustrated and described in the '691 patent, friction bearings of, for instance, Teflon, mounted on sections of aluminum channel, are attached to the underside of the upper body pad 14 and are slidably mounted in angle stock attached along the inner surfaces of the forward frame section sides. Resistance to movement of upper body pad 14 along angle stock is proportional to the weight exerted on the pad and is equal in the forward and rearward direction. The forward and rearward displacement or stroke of the upper body pad along angle stock is limited by the forward end 30 of the forward frame section 26 and the mounting arrangement for rollers 16. The upper body pad may comprise a plywood deck with foam rubber or other resilient padding material affixed to the upper surface and covered with a durable material offering frictional resistance to the head, shoulders and upper back of the patient.

Rollers 16 of conventional design are mounted in the forward frame section 26 and extend transversely of the frame with their axes parallel to one another at a location between end 34 and the upper body pad 14. The rollers are partially exposed above the forward frame section 26 to contact the patient's lower back or buttocks. The rollers are rotatably mounted to opposite sides of the frame by bronze pins extending from the axles of the rollers, through washers and holes drilled in the inner surfaces of aluminum channel 74 attached to the inner surfaces of the frame sides and into bearings that are press-fit into the channels.

Foot support platform 20 has a generally rectangular base 78 sized to fit horizontally between rearward frame section sides 48 and 50. A molded foot rest assembly 80 is attached to the upper surface of base 78. as described in my '691 patent, bearing blocks of, for instance, Teflon, are held against the lower surface of each corner of base 78 by bolts passing through holes in foot rest assembly 80, holes in base 78, holes in the bearing blocks and holes in sections of aluminum angle and threadedly received by nuts. Slots 100 formed in the outer surfaces of the bearing blocks receive the horizontal leg of the angle stock rigidly attached to the inner surfaces of frame sides 48 and 50 to slidingly support foot support platform 20 in the table frame 12.

The molded foot rest assembly 80 is attached to the top of base 78 and has a central console box 104 extending along its central front portion. Padded heel rests 110 are disposed on either side of console box 104, and footplate support brackets 112 are transversely spaced from one another at respective locations behind console box 104. Support brackets slidably and removably receive rectangular foot support plates 126 in a position wherein plates 126 extend upwardly and rearward from platform 20 in transversely spaced relation. A T-bar 106 has a stem portion 107 with a lower end extending toward base 78 through the space between brackets 112 to a location rearward of brackets 112. The width of the T-bar stem 107 permits it to fit between brackets 112, thereby permitting the stem to extend upwardly and forwardly between the brackets 112 and the foot support plates 126. Cross member 109 of T-bar 106 extends transversely in both directions from the top of stem 107 and has padded foot clamps 118 secured at each end thereof. Foot clamps 118 are hollow cylindrical padded members configured to slide onto respective ends of cross member 107 in positions forwardly of and in longitudinal alignment with respective foot plates 126.

T-bar stem 107 has a slot 111 defined therethrough and extending longitudinally along a portion of the stem. A threaded bolt 122 extends through slot 111 and is retained in threaded engagement with a threaded hole in console box 104. When the bolt is tightened in place by rotation of is actuator knob 124, the otherwise unsecured T-bar stem 107 is secured to the machine. The degree of insertion of bolt 122 into the hole in the console determines the slack space between foot clamps 118 and foot plates 126, thereby providing adjustability of that spacing for different patents. Importantly, once the spacing is set for a particular patient, it does not have to be re-adjusted for that patent.

The footplate support brackets 112 define respective slots on opposite sides of console box 104 and are sized to removably receive and support flat foot plates 126 in a generally upright position braced by support box 112. Foot plates 126 are removable for compact storage and portability.

As noted previously above, the method used in my prior machine to hold the patient's feet in the molded box involved a t-bar hinged at the bottom and held against the foot with pressure applied against the t-bar by a threaded handle. The aforementioned method of holding the feet in place was not very effective and was, in fact, ultimately replaced with two straps that went over the feet and around posts attached to the motor box. That strapping method, while holding the feet in place, also meant that a person with a bad back had to bend over to strap his/her feet in place.

The approach to holding the feet in place with the present invention uses T-bar 106 with a four inch adjustment slot 111 held in place on the molded box with a threaded handle 124. This system allows the user to set the T-bar one time and then to slide his/her feet into position from the sides, locking them in place while in a supine position when the machine is to be used. A second advantage to this approach is that the force applied to the T-bar presses the T-bar against the motor box, thereby stabilizing the T-bar instead of tending to tear it from the motor box.

Positioning arrows may be inscribed on the upper sides of the molded foot rest assembly to align with a series of marks inscribed along frame sides to indicate various separation distances between the upper body pad 14 and foot support platform 20 corresponding to various patient torso lengths.

As described in the '691 patent, transverse hinges may be mounted on the front and rear edges, respectively, of foot support platform 20 and are spring biased in a partially open position. Safety stop microswitches may be mounted on the front and rear edges, respectively, of foot support platform 20 and activated by the rotational closing of the hinges in response to a body part or other obstruction closing the hinge by blocking the unimpeded forward or backward movement of the foot support platform within frame 12. Activation of either microswitch causes the platform reciprocation to immediately stop, as is described more fully below, to prevent accidental injuries.

The drive system of the present invention uses a simple rotating arm driven by a gear motor. Specifically, 12VDC is fed from a wall adapter to a female plug 201 and is then routed for safety through a circuit breaker 202 and then to a four-position connector/junction box 204. From the connector the red wire in conductor cord 206 is fed to an on/off switch 207 in a control box 208. The green wire is energized when the switch 207 is turned on, and feeds 12VDC to the gear motor 205 through the red motor wire at the connector 204. The yellow wire from the switch 207 joins the brown wire at the connector 204 and then feeds current to timer 209. The black wire from the timer joins the black wire from the gear motor 205 at the connector. When the switch 207 is turned on, 12VDC is fed to the timer 209. When the timer is activated current is fed to the gear motor 205. The gear motor rotates a drive arm 210 and the machine is activated. The microswitch 203 activates the gear motor 205 until its actuator arm is depressed. Therefore, when the timer 209 completes its cycle, current is still fed to the gear motor 205 until the drive arm 210 contacts the microswitch 203 with a rubber bumper located under the end of the drive arm 210 opposite the bearing assembly 213. This opens the circuit and stops the gear motor in the correct position. The rotation of the drive arm 210 moves the motor box horizontally approximately seven inches in a reciprocating forward and rearward motion through a bearing assembly 212 and linkage arm 213 which is connected to the frame of the machine by a threaded retaining screw 214. Specifically, the distal end of linkage arm 213 passes through a space defined by the bottom surface of frame member 42 and a U-shaped bracket having the ends of its legs secured to that surface near the longitudinal center of member 42. Linkage arm 213 is provided with a series of longitudinally spaced apertures through which retaining screw can be selectively inserted to determine the effective length of arm 213 for operation with a patient of given torso and body length. The speed or pace of the reciprocating displacements is a function of the tube motor rotation speed.

This system allows the necessary motion to take place with a much simpler mechanism, thus saving a considerable amount of time and money, while accomplishing the same goal.

The new motor box 218 is vacuum formed in one piece instead of requiring the three pieces in my original unit. A plywood deck 219 is glued in the inside of the motor box 218. This plywood deck 219 has pre-drilled holes with tee-nuts installed to provide a solid method of attaching the gear motor and other parts.

In use of the machine, a patient first positions upper body pad 14. Foot support platform 20 is then positioned to accommodate the torso length of the patient. The patient lies supine on the table with head, shoulders and upper back resting on upper body pad 14 and lower back and buttocks resting on rollers 16. The patient's feet are inserted under pre-positioned foot clamps 118, with the bottoms of the feet pressed against foot plates 126 and the backs of the feet resting on heel rests 110 to comfortably secure the feet in position between the heel rests and foot clamps.

The therapeutic treatment machine is then energized by turning the on-off switch "on" position. The motor rotates, driving the foot support platform 20 along frame sides 48 and 50, supported and guided by slots in bearing blocks. Operation proceeds in the manner described above in connection with the description of the motor circuit.

The weight or force exerted by the head, shoulders and upper back of the patient on the upper body pad 14 controls the frictional resistance to sliding developed between friction bearings and the angle stock and is equal in the forward and rearward direction. When the compression or tension force transmitted through the body of the patient by the reciprocating foot support platform exceeds the frictional force between the friction bearings and the angle stock, the upper body pad will slide along the table frame to relieve and prevent additional force from being carried by the body. Consequently the patient can control the magnitude of tension and compression forces applied by the therapeutic treatment machine by increasing or decreasing the amount of body weight applied to the upper body pad. The platform continues to cycle back and forth applying alternating compression and traction to the patient until turned off at the on-off switch or until an obstruction of foot support platform 20 activates a safety stop microswitch.

During compression, posterior tilting of the pelvis takes place, decreasing lumbar lordosis, relaxing the posterior elements of the spine and compressing the anterior elements. During traction the pelvis tilts forward causing extension of the lumbar spine. The increase in lumbar lordosis causes compression of the posterior elements and traction of the anterior elements.

When the treatment is concluded the machine can be partially dismantled for compact storage or ease of portability by removing legs 40, T-bar 106 and foot plates 126, and folding forward section 26 and rearward section 28 together.

A timer is included in the circuitry to allow the user to preset a duration for traction-compression cycling. A microprocessor based controller can be used to program the nature and duration of treatment. Furthermore, a simple ice bath of conventional design can effectively be incorporated into the roller apparatus to provide further therapeutic action or alternatively, the rollers can be replaced by a temperature controllable waterbag having low sliding resistance to allow the patient's mid body to slide freely during compression and traction.

The power to drive the reciprocating movement of the foot support platform can be provided alternatively by a conventional rack and pinion drive, a screw actuator, a hydraulic piston or a drive wheel. In addition the braking action exerted by the weight of the patient's upper body acting frictionally on the bearing pads can alternatively be provided by conventional mechanical, electrical or hydraulic brakes or by force exerted by the patient against handles attached to the frame. A preferred mode of operation of the present invention involves applying forces of equal magnitude during the compression and traction, or pushing and pulling, sequences. The magnitude of the compression and tension force applied to the patient's body depends on the force exerted on the upper body pad. Typically forces applied to the patient are in the range of ten to seventy pounds.

In view of the foregoing it is apparent that the present invention provides a therapeutic treatment machine capable of applying alternating cycles of preselected degrees of compression and traction to the back and spinal column or to other portions of a patients body.

The machine is adjustable to accommodate different torso lengths and allows the patient to control the duration, frequency and intensity of treatment. The sliding engagement between the patient and the upper body support pad combines ease of control and protection against the application of excessive forces. Safety step switches activated by any obstruction in the path of the reciprocating foot support platform prevent accidental injury to the patient or others and the use of stepped-down 12 volt AC converted to DC at the machine minimizes electrical risk. The fold-away nature of the hinged table and removable legs and T-bar allows the machine to portably accompany the patient to provide treatment while traveling.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A therapeutic treatment machine for applying sequences of selected amounts of alternating tension and compression between two portions of the body of a patient comprising:

a frame having a forward section and a rearward section supported by a plurality of legs, said forward and rearward sections being separate members that are hinged together to permit said sections to be folded together;

a pad of size and configuration suitable for supporting the upper torso portion of a patient in a supine position, said pad being mounted within said forward section of said frame;

a plurality of rollers mounted in said frame with respective rotational axes extending transversely of said frame, at least some of said rollers being positioned and configured to support the lower torso portion of a patient in said supine position;

a foot support platform of sufficient size and configuration for supporting and securing the feet of said patient in said supine position, and mounted within said rearward section of said frame;

drive means for cyclically moving said platform forcefully in the forward direction and alternatingly moving said platform forcefully in the rearward direction, said drive means comprising:

a motor for producing rotation in a driven member;

a linkage arm;

means for converting rotational movement in said driven member to longitudinal reciprocation of said linkage arm; and means for moving said platform longitudinally with said linkage arm.;

wherein said foot support platform comprises:

a support surface;

first and second foot rests secured to said surface in transversely spaced relation for supporting the heel portions of the patient's feet;

first and second foot support plates;

bracket means for removably securing said first and second foot support plates in transversely spaced relation and in substantial longitudinal alignment with said first and second foot rests for supporting the bottoms of the patient's feet;

first and second foot clamps for engaging the tops of the patient's feet and, in cooperation with said foot support plates, holding the patient's feet in place against longitudinal movement; and mounting means for removably securing said foot clamps to said foot support platform, said mounting means comprising:

a T-bar having a stem and a cross member, wherein said stem is sized and configured to fit between said first and second foot plates, said stem having an end remote from said cross member and a longitudinally extending slot defined therethrough;

means securing said foot clamps to respective ends of said cross member; and a threaded bolt for securing said T-bar to said platform in a manner to permit said stem to move longitudinally, said bolt extending freely through the slot so as to be slideable along the length of the slot while being retained in the slot, said bolt having a distal end threadedly engaging said platform and a proximal handle end, wherein said T-Bar is free to move along the stem length dimension while being restrained by said bolt from being displaced away from the platform in a direction transverse to the stem length dimension.

2. The therapeutic treatment machine of claim 1 wherein said frame is a generally rectangular frame comprising tubular frame members interconnected at corners of the frame by respective corner members, each corner member comprising:

a corner portion;

first and second arms extending from orthogonally oriented sides of said corner portion, said arms adapted to be slidably received in ends of respective tubular frame members; and adhesive means for securing said first and second arms in said respective tubular frame members.

3. The therapeutic treatment machine of claim 2 wherein each of said first and second arms is a generally U-shaped member formed integrally as one piece with said corner portion and having a base disposed at said corner portion and two spaced sides extending distally, wherein said adhesive means secures each of said sides to a respective inner surface of a tubular frame member.

4. The therapeutic treatment machine of claim 2 wherein said frame is supported by a plurality of legs at each of said corners, wherein each of said corner members includes a leg support member extending orthogonally to said first and second arms from said corner portion and configured to telescopically engage a respective leg.

5. The therapeutic treatment machine of claim 4 wherein said corner member, said first and second arms and said leg support member are formed of a single piece of cast aluminum.

6. A therapeutic treatment machine for applying sequences of selected amounts of alternating tension and compression between two portions of the body of a patient comprising:

a frame having a forward section and a rearward section supported by a plurality of legs, said forward and rearward sections being separate members that are hinged together to permit said sections to be folded together;

a pad of sufficient size and configuration for supporting the upper torso portion of a patient in a supine position, said pad being mounted within said forward section of said frame;

low friction support means mounted in said frame for supporting the lower torso portion of a patient in said supine position;

a foot support platform of sufficient size and configuration for supporting and securing the feet of said patient in said supine position, and mounted within said rearward section of said frame;

drive means for cyclically moving said platform forcefully in the forward direction and alternatingly moving said platform forcefully in the rearward direction;

wherein said frame is a generally rectangular frame comprising tubular frame members interconnected at corners of the frame by respective corner members, each corner member comprising:

a corner portion;

first and second arms extending from orthogonally oriented sides of said corner portion, said arms adapted to be slidably received in ends of respective tubular frame members; and adhesive means for securing said first and second arms in said respective tubular frame members;

wherein said foot support platform comprises:

a support surface;

first and second foot rests secured to said surface in transversely spaced relation for supporting the heel portions of the patient's feet;

first and second foot support plates;

bracket means for removably securing said first and second foot support plates in transversely spaced relation and in substantial longitudinal alignment with said first and second foot rests for supporting the bottoms of the patient's feet;

first and second foot clamps for engaging the tops of the patient's feet and, in cooperation with said foot support plates, holding the patient's feet in place against longitudinal movement; and mounting means for removably securing said foot clamps to said foot support platform, said mounting means comprising:

a T-bar having a stem and a cross member, wherein said stem is sized and configured to fit between said first and second foot plates, said stem having a longitudinally extending slot defined therethrough;

means securing said foot clamps to respective ends of said cross member; and a threaded bolt for securing said T-bar to said platform in a manner to permit said stem to move longitudinally, said bolt extending freely through the slot so as to be slideable along the length of the slot while being retained in the slot, said bolt having a distal end threadedly engaging said platform and a proximal handle end, wherein said T-Bar is free to move along the stem length dimension while being restrained by said bolt from being displaced away from the platform in a direction transverse to the stem length dimension.

7. The therapeutic treatment machine of claim 6 wherein each of said first and second arms is a generally U-shaped member formed integrally as one piece with said corner portion and having a base disposed at said corner portion and two spaced sides extending distally, wherein said adhesive means secures each of said sides to a respective inner surface of a tubular frame member.

8. The therapeutic treatment machine of claim 7 wherein said frame is supported by a plurality of legs at each of said corners, wherein each of said corner members includes a leg support member extending orthogonally to said first and second arms from said corner portion and configured to telescopically engage a respective leg.

9. The therapeutic treatment machine of claim 8 wherein said corner member, said first and second arms and said leg support member are formed of a single piece of cast aluminum.

10. A therapeutic treatment machine for applying sequences of selected amounts of alternating tension and compression between two portions of the body of a patient comprising:

a frame having a forward section and a rearward section supported by a plurality of legs, said forward and rearward sections being separate members that are hinged together to permit said sections to be folded together;

a pad of size and configuration suitable for supporting the upper torso portion of a patient in a supine position, said pad being mounted within said forward section of said frame;

low friction support means mounted in said frame for supporting the lower torso portion of a patient in said supine position;

a foot support platform of sufficient size and configuration for supporting and securing the feet of said patient in said supine position, and mounted within said rearward section of said frame;

drive means for cyclically moving said platform forcefully in the forward direction and alternatingly moving said platform forcefully in the rearward direction, said drive means comprising:

a motor for producing rotation in a driven member;

a linkage arm;

means for converting rotational movement in said driven member to longitudinal reciprocation of said linkage arm; and means for moving said platform longitudinally with said linkage arm;

wherein said foot support platform comprises:

a support surface;

foot rest means secured to said surface for supporting the heel portions of the patient's feet;

first and second foot support plates;

bracket means for removably securing said first and second foot support plates in transversely spaced relation and in substantial longitudinal alignment with foot rest means for supporting the bottoms of the patient's feet;

first and second padded foot clamps for engaging the tops of the patient's feet and, in cooperation with said foot support plates, holding the patient's feet in place against longitudinal movement; and mounting means for removably securing said foot clamps to said foot support platform, said mounting means comprising:

a T-bar having a stem and a cross member, wherein said stem is sized and configured to fit between said first and second foot plates, said stem having a longitudinally extending slot defined therethrough;

means securing said foot clamps to respective ends of said cross member; and a threaded bolt for securing said T-bar to said platform in a manner to permit said stem to move longitudinally, said bolt extending freely through the slot so as to be slideable along the length of the slot while being retained in the slot, said bolt having a distal end threadedly engaging said platform and a proximal handle end, wherein said T-Bar is free to move along the stem length dimension while being restrained by said bolt from being displaced away from the platform in a direction transverse to the stem length dimension.

11. The therapeutic treatment machine of claim 10 wherein said frame is a generally rectangular frame comprising tubular frame members interconnected at corners of the frame by respective corner members, each corner member comprising:

a corner portion;

first and second arms extending from orthogonally oriented sides of said corner portion, said arms adapted to be slidably received in ends of respective tubular frame members; and adhesive means for securing said first and second arms in said respective tubular frame members.

12. The therapeutic treatment machine of claim 11 wherein each of said first and second arms is a generally U-shaped member formed integrally as one piece with said corner portion and having a base disposed at said corner portion and two spaced sides extending distally, wherein said adhesive means secures each of said sides to a respective inner surface of a tubular frame member.

13. The therapeutic treatment machine of claim 11 wherein said frame is supported by a plurality of legs at each of said corners, wherein each of said corner members includes a leg support member extending orthogonally to said first and second arms from said corner portion and configured to telescopically engage a respective leg.

14. The therapeutic treatment machine of claim 13 wherein said corner member, said first and second arms and said leg support member are formed of a single piece of cast aluminum.

* * * * *